US012584655B2

(12) United States Patent
Haney et al.

(10) Patent No.: US 12,584,655 B2
(45) Date of Patent: Mar. 24, 2026

(54) PRESSURE WATER HEATER

(71) Applicants: Michael Haney, Modesto, CA (US); James Tygart, Modesto, CA (US); Gary Tackett, Modesto, CA (US)

(72) Inventors: Michael Haney, Modesto, CA (US); James Tygart, Modesto, CA (US); Gary Tackett, Modesto, CA (US)

( * ) Notice: Subject to any disclaimer, the term of this patent is extended or adjusted under 35 U.S.C. 154(b) by 416 days.

(21) Appl. No.: 18/103,580

(22) Filed: Jan. 31, 2023

(65) Prior Publication Data

US 2024/0255179 A1 Aug. 1, 2024

(51) Int. Cl.
*B08B 13/00* (2006.01)
*F24H 1/10* (2022.01)
*F24H 9/00* (2022.01)

(52) U.S. Cl.
CPC ..... *F24H 1/10* (2013.01); *F24H 9/0005* (2013.01)

(58) Field of Classification Search
CPC ..... F24H 1/10; F24H 9/0005; B08B 7/0071; B08B 13/00; A47L 2501/26
USPC ..... 122/DIG. 10, 40
See application file for complete search history.

(56) References Cited

U.S. PATENT DOCUMENTS 4,913,345 A * 4/1990 Setter ..... A01M 7/0042 239/304
5,309,310 A * 5/1994 Baer ..... H02J 13/00022 361/45
5,385,106 A * 1/1995 Langshaw ..... A01M 21/04 239/130
5,927,601 A * 7/1999 Newson ..... A01M 21/04 47/1.5
6,227,460 B1 * 5/2001 Funk ..... B60S 3/00 239/131
7,100,540 B2 * 9/2006 Vaughan ..... B05B 9/002 122/DIG. 10
7,963,463 B2 * 6/2011 Breedlove ..... B08B 3/026 239/422
8,038,081 B2 * 10/2011 Hendy ..... B08B 3/02 239/128
8,814,531 B2 * 8/2014 Raasch ..... B01F 25/31243 417/174
10,328,838 B2 * 6/2019 Yim ..... B60T 1/04
11,629,884 B2 * 4/2023 Chaudhry ..... G05B 15/02 122/14.3
2001/0022323 A1 * 9/2001 Aslakson ..... B08B 3/026 280/789
2006/0027253 A1 * 2/2006 Kaiser ..... B08B 3/026 134/108
2009/0065607 A1 * 3/2009 Gardner ..... A46B 11/066 239/589

(Continued)

FOREIGN PATENT DOCUMENTS

WO WO-2007113613 A1 * 10/2007 ..... F24H 1/121
WO WO-2011018661 A1 * 2/2011 ..... B08B 3/02

*Primary Examiner* — Gregory A Wilson
(74) *Attorney, Agent, or Firm* — Lyman Moulton, Esq.; Moulta Patents, PLLC

(57) ABSTRACT

This innovative, top-quality product ensures a fully operational device that will benefit all individuals interested in a cost effective means to convert a cold water pressure washer into a hot water pressure washer. Thus the user will have the full benefit of the cleaning capabilities of both a hot water pressure washer and a cold water pressure washer.

12 Claims, 3 Drawing Sheets

(56) References Cited

U.S. PATENT DOCUMENTS

| | | | | |
|---|---|---|---|---|
| 2011/0131752 | A1* | 6/2011 | Place | E01H 1/103<br>134/105 |
| 2019/0160497 | A1* | 5/2019 | Sanger | B08B 3/028 |
| 2022/0401602 | A1* | 12/2022 | Guay | B63B 59/06 |

* cited by examiner

PRESSURE WATER HEATER

BACKGROUND

Hot water pressure washers are known to clean faster than cold water washers, providing surface deep results. Cold water washers, in comparison, are especially effective in removing grease, grime and oil. On demand hot water pressure washers, however, can cost up to ten thousand dollars and can be incredibly tedious and challenging to install. There have been no products available as original equipment or as an aftermarket to address this problem.

An apparatus that gives users the flexibility to use both hot water pressure and cold water pressure thus being able to clean effectively with ease is not being met by any known device or system at present. There have been no products available as original equipment or as an aftermarket to address this problem either.

SUMMARY OF THE INVENTION

The main purpose of the pressure water heater is to provide users with a method of converting an existing cold water pressure washer into a hot water pressure washer for improved function.

A pressure water heater includes a tankless water heater having an ambient water input and a hot water output and mounted to a frame of a pressure washer wherein the hot water output is connected to the pressure washer input and a pressurized water output of the pressure washer comprises a pressurized hot water. Serial and parallel connections from multiple tankless water heaters in hybrid connections including gas and electric units are also disclosed.

Figure 1:
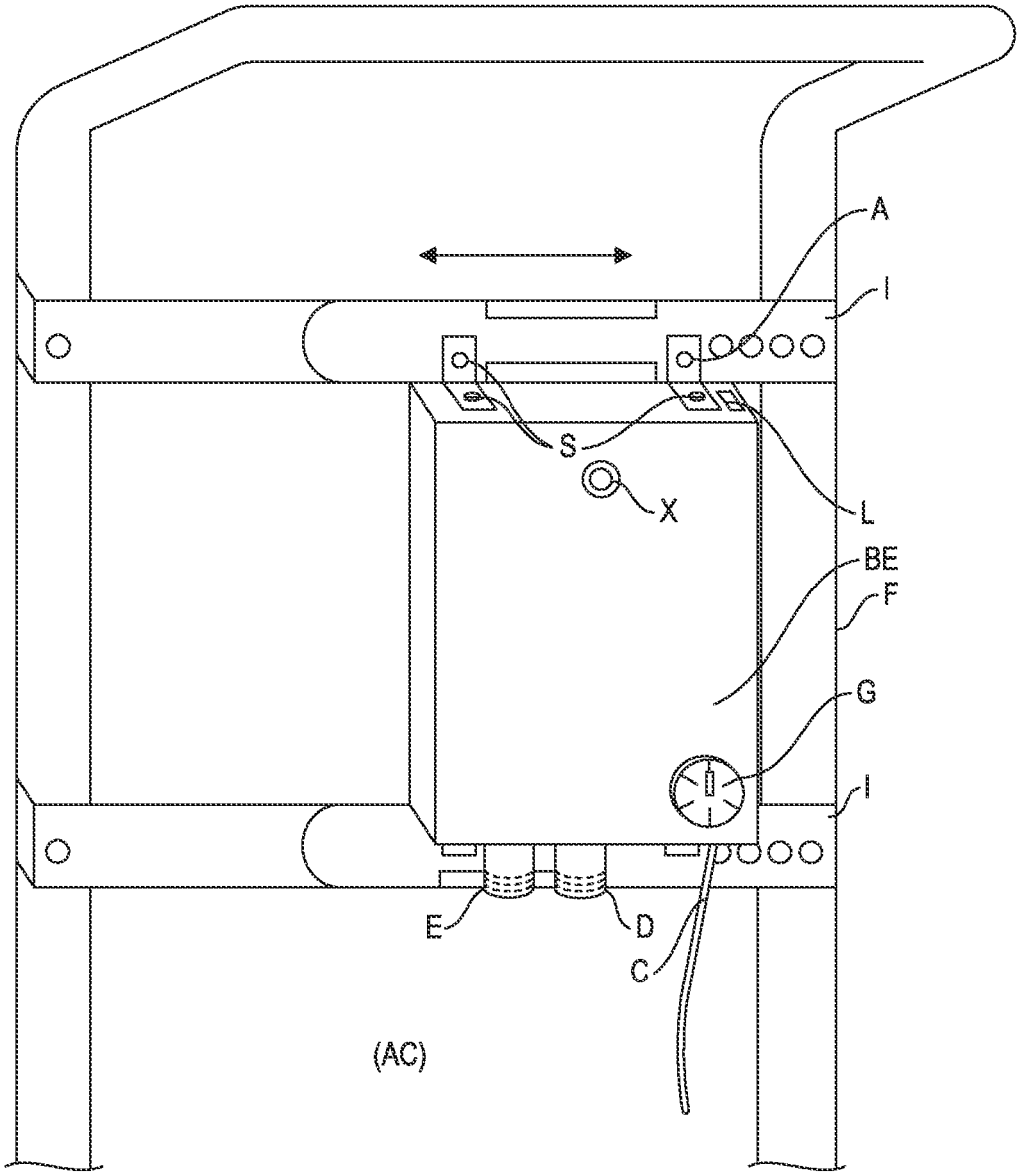
FIG. 1 is a back perspective view of the pressure water heater tankless water heater mounting in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a back perspective view of the pressure water heater tankless water heater showing: mounting L-clips to water heater referenced as A, tankless water heater referenced as B, 120V/240V power cord with GFI referenced as C, cold water hose bib inlet referenced as D, hot water hose bib outlet referenced as E, power light referenced as X, temperature setting referenced as G, adjustable mounting brackets to mount heater clips referenced as I, pressure washer frame referenced as J, switch button referenced as L, in accordance with an embodiment of the present disclosure. Self tapping screws S mount the "L" brackets and the tankless water heater BE to the uprights handles of the pressure washer (not depicted). The frame F of the pressure washer is used to keep the tankless water heater BE in proximity thereto.

Figure 2:
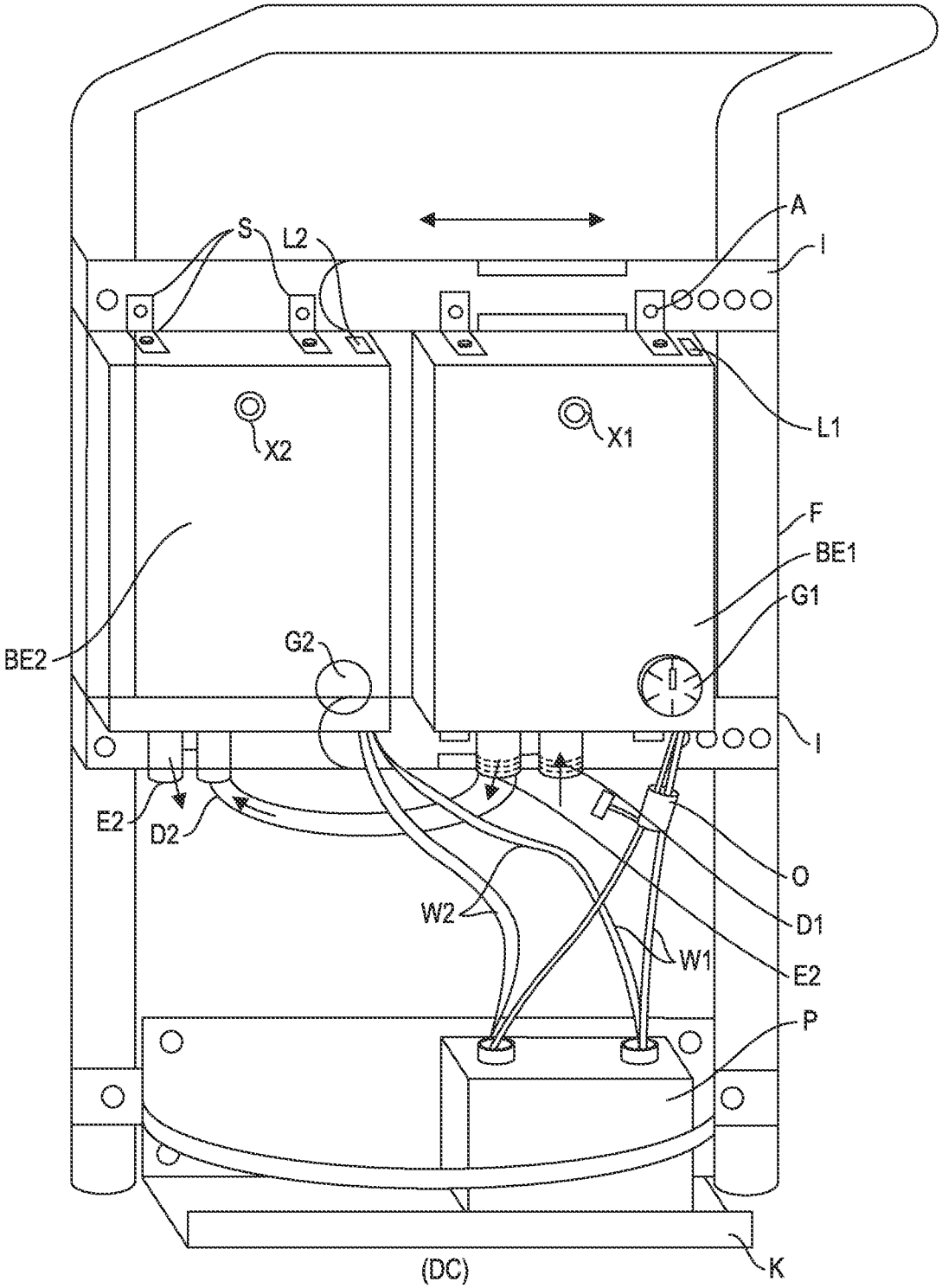
FIG. 2 is a back perspective view of the pressure water heater with dual electric tankless water heaters in accordance with an embodiment of the present disclosure.

FIG. 2 is a back perspective view of the pressure water heater with dual electric tankless water heaters showing: mounting L-clips to water heater referenced as A, tankless water heater referenced as BE1 and BE2, cold water hose bib inlet referenced as D, hot water hose bib outlet referenced as E2 which is connected in series to the second tankless water heater via D2 inlet, frame F, power light referenced as X1 and X2, temperature setting referenced as G1 and G2, adjustable mounting brackets to mount heater clips referenced as I, pressure washer frame referenced as F, battery bracket holder or shelf referenced as K, switch button referenced as L1 and L2, 12V hook up and charging wire harness referenced as O, battery 12V referenced as P, self tapping screws referenced as S and wires W1 and W2 to service the tankless water heaters BE1 and BE2 respectively in accordance with an embodiment of the present disclosure.

Figure 3:
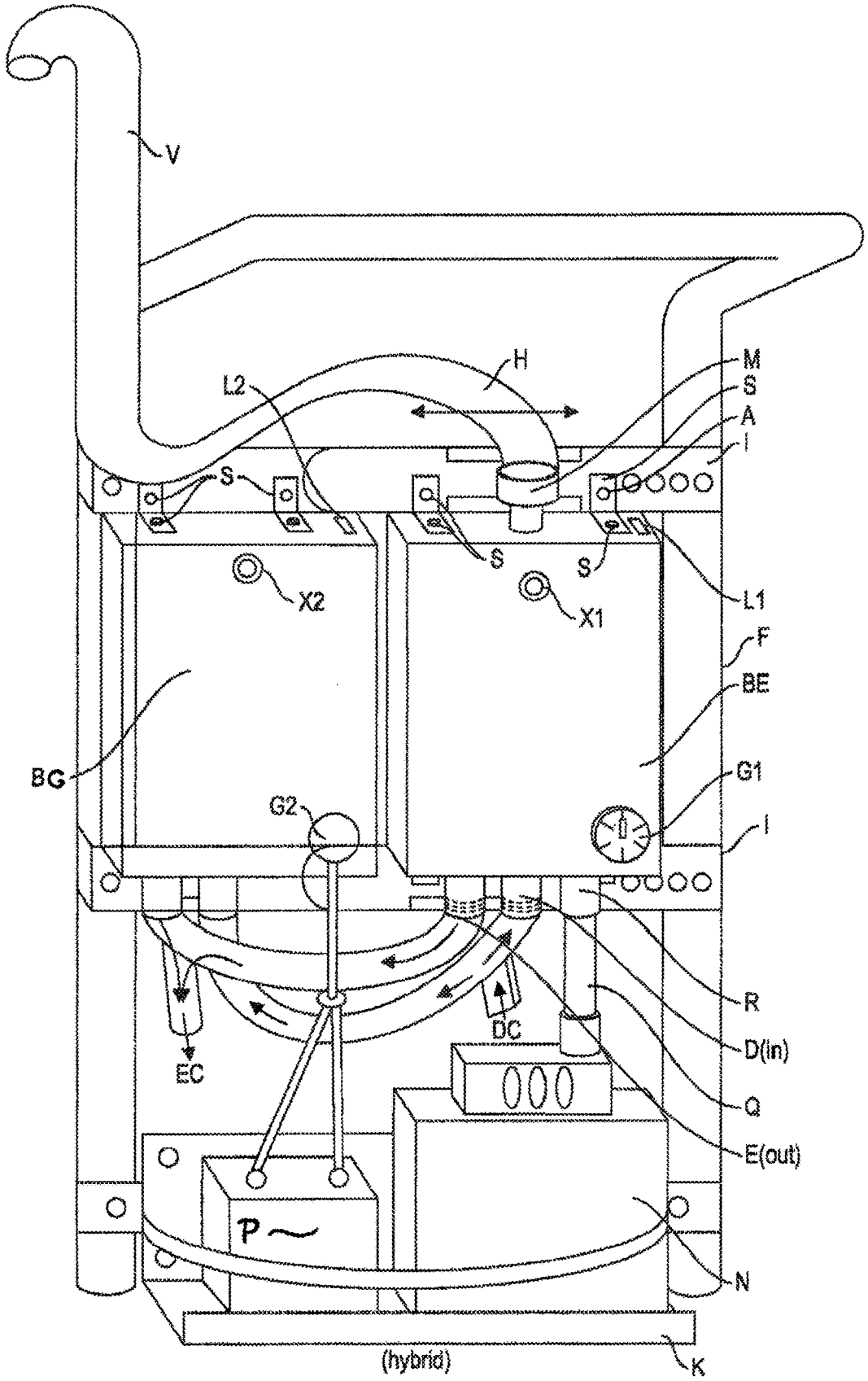
FIG. 3 is a back perspective view of the pressure water heater in with hybrid electric and LP gas water heaters in accordance with an embodiment of the present disclosure.

FIG. 3 is a back perspective view of the pressure water heater with hybrid electric and LP gas tankless water heaters showing: mounting L-clips to water heater referenced as A, tankless water heater referenced as BG (gas) and BE (electric), cold water hose bib inlet referenced as DC in a T common connection with both tankless water heater inputs, hot water hose bib outlet referenced as EC in a T common connection with both tankless water heater outputs, frame F, power light referenced as X1 and X2, temperature setting referenced as G1 and G2, adjustable mounting brackets to mount heater clips referenced as I, pressure washer frame referenced as F, battery P and bracket holder referenced as K, switch button referenced as L1 and L2, tank exhaust vent referenced as M in communication with vent V via the hose H, LP tank referenced as N, LP supply hose referenced as Q, LP hookup referenced as R, and self tapping screws S in accordance with an embodiment of the present disclosure. Tank N is the primary LP tank and in many instances the only LP tank. Further LP tanks are added in series and in parallel for larger and more demanding tasks.

The LP tank N is provided separately in embodiments and is included in a kit in other embodiments according to market and technical needs. A ¾×8 inch hose for cold water through an inlet nipple and a ¾×36 inch hot water output is also included. Therefore, both hoses are part of one and up to 3 different kits targeted to market and technical needs.

The present disclosed pressure water heater, also known as "The Pressure Heater Kit", offers a modern device that allows users to easily and quickly transform a cold water pressure washer into a hot water pressure washer, eliminating the hefty financial cost and labor otherwise associated with the transition. Expanding on the initial design of an average cold water pressure washer, the Pressure Heater Kit introduces a novel universal heating kit possessing a tankless hot water heater, a cold water inlet hose bib that attaches to the heater supply line and a hot water heater exit to pressure the inlet hose bib supply line as the primary connection. In addition, universal, mounting brackets are employed to ensure the apparatus can be conveniently installed onto any and all cold water pressure washers. Users simply mount the hot water heater to the pressure washer. The hose bib is attached via connectors to the inlet side and outlet side of the water heater. Next, the water heater outlet is connected to the side of the pressure washer inlet hose bib connector. The water hose is connected to the inlet side of the water heater. A GFCI 120 v/240 v cord is attached or battery packs supply power to the water heater through an inverter. By attaching the heating module to a cold water pressure washer, the pressurized water is now heated to produce all the benefits of a hot water power washing machine, in a reliable and simplified manner.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A pressure water heater comprising:

a tankless water heater having an ambient water input and a hot water output and mounted to a frame of a pressure washer wherein the hot water output is connected to the pressure washer input and a pressurized water output of the pressure washer comprises a pressurized hot water; and a hybrid electric and an LP gas tankless water heater pair comprising the ambient water input and the hot water output for the tankless water heater.

2. The pressure water heater of claim 1, wherein a power for the tankless water heater and the pressure washer is supplied by a DC battery mounted via a shelf on the frame of the pressure washer.

3. The pressure water heater of claim 1, wherein the tankless water heater is an LP water heater and a power for the tankless water heater is supplied by an LP gas tank.

4. The pressure water heater of claim 1, wherein a power for the tankless water heater and the pressure washer is supplied by a 120V/240V power cord with a GFI (ground fault interrupter) circuit adjacent thereto.

5. The pressure water heater of claim 1, wherein the LP tankless water heater and the electric tankless water heater pair are connected in a serial water flow and powered by a respective LP gas tank and a DC battery source.

6. The pressure water heater of claim 1, wherein the LP tankless water heater and the electric tankless water heater pair are connected in a parallel water flow and powered by a respective LP gas tank and an electric source.

7. The pressure water heater of claim 1, wherein a temperature setting for the hot water is determined by a preheater first tankless water heater and a second stage second tankless water heater acting in tandem.

8. The pressure water heater of claim 1, wherein the tankless water heater is mounted to the frame of the pressure water heater via a plurality of self tapping screws.

9. The pressure water heater of claim 1, wherein the LP tankless water heater is vented to a height greater than 7 feet from surface via a pipe connected to an exhaust of the LP tankless water heater.

10. The pressure water heater of claim 1, wherein a tandem arrangement of the hybrid electric and the LP gas tankless water heater pair comprises a common ambient water input and a common hot water output.

11. The pressure water heater of claim 1, further comprising a common hose bib connection between a garden hose water input and the tankless ambient water input.

12. The pressure water heater of claim 1, wherein the tankless water heater is mounted to the pressure washer frame via a plurality of "L" brackets.

* * * * *